US007922605B2

(12) United States Patent
Lim

(10) Patent No.: US 7,922,605 B2
(45) Date of Patent: Apr. 12, 2011

(54) BALL MARKER FOR GOLF

(76) Inventor: Seong-Kyu Lim, Daegu (KR)

( * ) Notice: Subject to any disclaimer, the term of this patent is extended or adjusted under 35 U.S.C. 154(b) by 0 days.

(21) Appl. No.: 12/711,888

(22) Filed: Feb. 24, 2010

(65) Prior Publication Data

US 2010/0151972 A1 Jun. 17, 2010

Related U.S. Application Data

(63) Continuation of application No. PCT/KR2008/004892, filed on Aug. 21, 2008.

(30) Foreign Application Priority Data

Aug. 24, 2007 (KR) ..... 10-2007-0085607
Dec. 7, 2007 (KR) ..... 10-2007-0126528

(51) Int. Cl.
*A63B 57/00* (2006.01)

(52) U.S. Cl. ..... 473/406

(58) Field of Classification Search ..... 473/406, 473/285; 362/104; 24/114.9
See application file for complete search history.

(56) References Cited

U.S. PATENT DOCUMENTS 4,672,718 A * 6/1987 Schlueter et al. ..... 24/114.9
5,569,103 A * 10/1996 Sihn ..... 473/406
6,659,617 B1 * 12/2003 Michael ..... 362/104
7,360,926 B2 * 4/2008 Lee ..... 362/104
7,727,087 B2 * 6/2010 Houghton ..... 473/406
2002/0115506 A1 * 8/2002 Kim ..... 473/406
2006/0214778 A1 * 9/2006 Beckwith et al. ..... 340/330

FOREIGN PATENT DOCUMENTS

JP 05070565 9/1993
JP 2646157 5/1997
JP 2005312870 11/2005
KR 1020080057124 6/2008

OTHER PUBLICATIONS

International Search Report mailed Oct. 15, 2008 for PCT/KR2008/004892, citing the above references.

* cited by examiner

*Primary Examiner* — Steven Wong
(74) *Attorney, Agent, or Firm* — Lowe Hauptman Ham & Berner LLP

(57) ABSTRACT

Provided is a ball marker for golf, including: a round-shaped case having an opening; a disc spring fit to the round-shaped case; a thin film printed circuit board and a flexible printed circuit cable seated on a top surface of the disc spring, the thin film printed circuit board having a light-emitting diode flickering control chip, the flexible printed circuit cable being connected to the thin film printed circuit board and having a plurality of surface mounted device light emission diodes; a transparent rubber layer formed on the thin film printed circuit board and the flexible printed circuit cable; an electric cell received in a receiving portion of the disc spring exposed from a lower portion of the round-shaped case; a button switch and a button cover arranged on the electric cell; and a lower fixing portion fused and fixed with soft resin.

8 Claims, 4 Drawing Sheets

[Fig. 1]
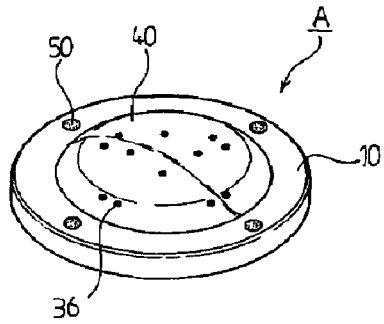
[Fig. 2]
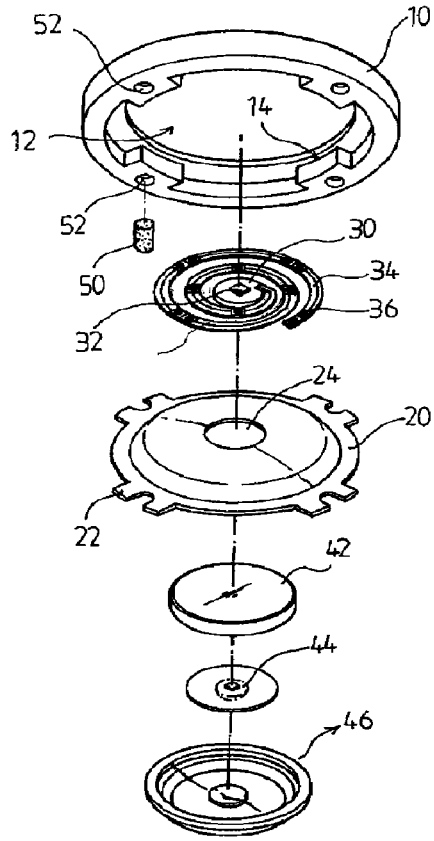
[Fig. 3]
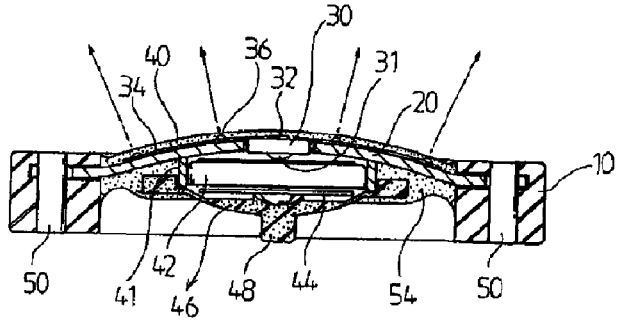

[Fig. 4]
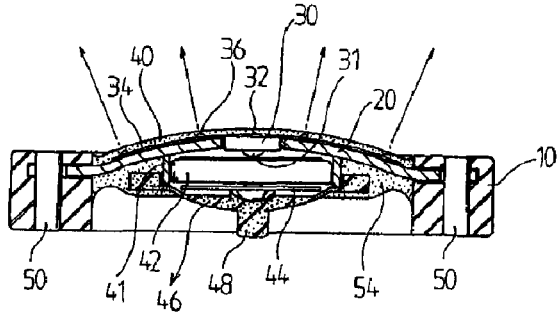
[Fig. 5]
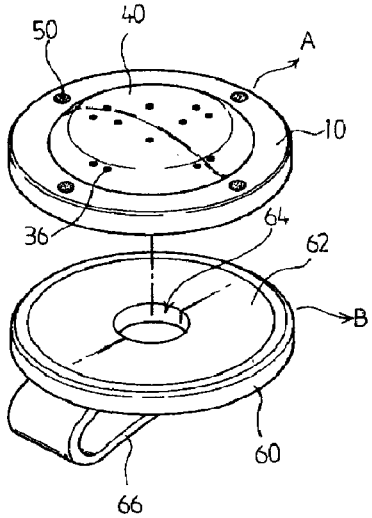
[Fig. 6]
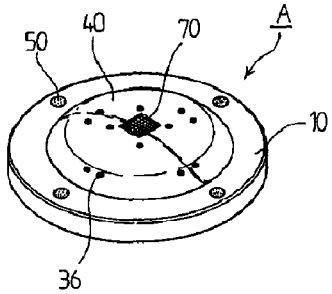
[Fig. 7]
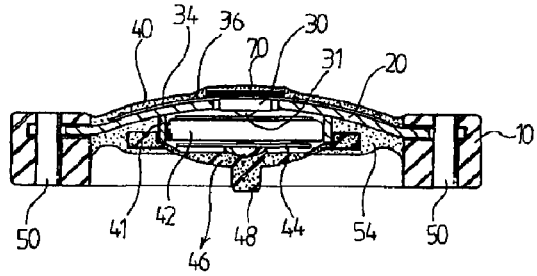

[Fig. 8]
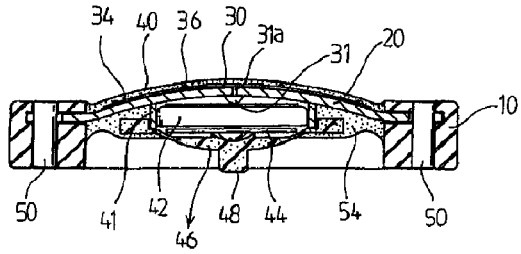
[Fig. 9]
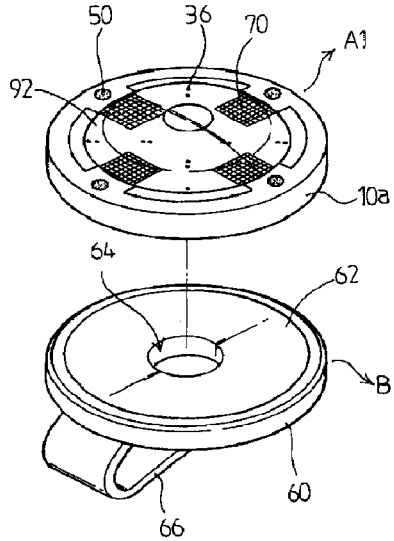
[Fig. 10]
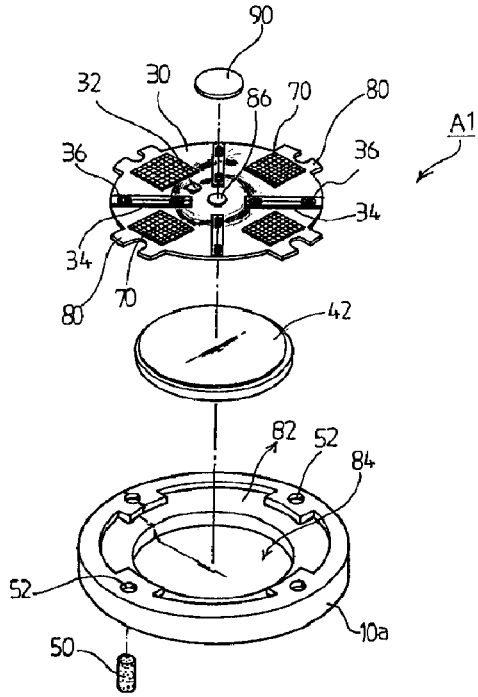

[Fig. 11]
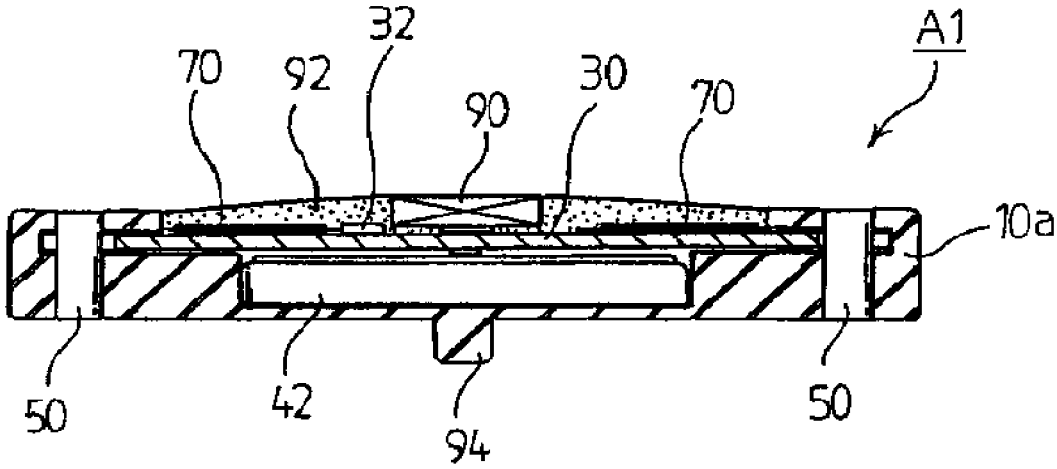

BALL MARKER FOR GOLF

CROSS-REFERENCE TO RELATED APPLICATIONS

The present application is a continuation application of PCT/KR2008/004892 filed on Aug. 21, 2008 which claims priority from Korean Patent Application No. 2007-0085607 filed on Aug. 24, 2007 and Korean Patent Application No. 2007-0126528 filed on Dec. 7, 2007, which are incorporated herein by reference in the entirety.

BACKGROUND ART

The present invention relates to an improve ball marker for golf.

In general, while golfers can putt a ball to a distance of 200 meter to 300 meter in one stroke, they have a number of examples that they cannot make a hole-in-one even at a distance shorter than 1 meter on a putting green. The putting green is the only area where the golfer can directly pick up, touch and wash the ball with the hand on his or her golf game. Since putting on the putting green requires sensitiveness, high delicacy and high power of concentration, the golfer can put a mark of the ball directly behind the ball (position far from a hole cup) and remove and wash soil or foreign matters stained on the ball after picking up the ball, and after that, must put a ball mark at the original position of the ball and remove the ball in order not to obstruct other golfer's putting. When the golfer's turn comes, the golfer replaces the ball at the position of the ball mark and continues the game after removing the ball mark.

If an area between the ball and the hole cup on the putting green is level, a difficulty in putting may be reduced greatly. However, since the green surface ranging from the ball to the hole cup has curves and inclined surfaces of various forms, it is very important to correctly read a green lie between the ball and the hole cup. The reason is to determine an advance direction of the ball and the degree of power adjustment at the time of putting when the golfer correctly reads the green lie.

In order to read the green lie, golfers generally mark the position of the ball with a ball marker and check the position of the ball marker from the rear of the hole cup, which is opposite to the ball marker. In this instance, while the golfer can easily find the ball marker if the ball marker is located in an area near to the hole cup (for instance, within a range of 1 meter to 3 meter), the golfer has to pay careful attention to find the ball marker if the ball marker is far away more than 10 meter from the hole cup. In detail, since it is good that a height of his or her sight is near to the green surface to correctly read the green lie, the golfer frequently lies down flat on the ground. According to circumstances, when the golfer cannot see the ball marker satisfactorily due to the curve of the ground or because the ball marker is hidden into the grass of the putting green, the golfer has to stand up. Accordingly, the golfer has to frequently repeat behaviors to sit down and stand up.

Furthermore, the golfer cannot sometimes satisfactorily grasp the position of the ball marker due to excessively strong sunshine or feels difficulty to find the ball marker in a cloudy weather, at dawn, at night, or under night illumination.

Accordingly, the present invention has been made in an effort to solve the above-mentioned problems occurring in the prior arts, and it is an object of the present invention to provide a ball marker for golf, which allows a golfer to easily check a position of ball mark.

Another object of the present invention is to provide a ball marker for golf, which allows the golfer to more positively recognize the position of the ball mark and helps the golfer to measure a distance.

Yet another object of the present invention is to provide a ball marker for golf, which can adjust the degree of position indication of the ball mark, and which is easy to carry.

SUMMARY

To achieve the above objects, the present invention provides a ball marker for golf comprising: a round-shaped case having an opening; a disc spring fit to the round-shaped case; a thin film printed circuit board and a flexible printed circuit cable seated on a top surface of the disc spring exposed to an upper portion of the round-shaped case, the thin film printed circuit board having a light-emitting diode flickering control chip, the flexible printed circuit cable being connected to the thin film printed circuit board and having a plurality of surface mounted device light emission diodes; a transparent rubber layer hardened and formed on the thin film printed circuit board and the flexible printed circuit cable; an electric cell received in a receiving portion of the disc spring exposed from a lower portion of the round-shaped case; a button switch and a button cover laminatedly arranged on the electric cell; and a lower fixing portion fused and fixed with soft resin.

Furthermore, in another aspect of the present invention, the present invention provides a ball marker for golf comprising: a round-shaped case having an upper recess; a thin film printed circuit board fit into the round-shaped case and having a light-emitting diode flickering control chip, the thin film printed circuit board being connected with a flexible printed circuit cable having a plurality of surface mounted device light emission diodes; a solar cell part and a switch button laminatedly arranged on a portion of an top surface of the thin film printed circuit board; and a transparent layer hardened and formed on the thin film printed circuit board in such a way that the switch button is exposed to the outside.

The ball marker for golf according to the present invention can allow the golfer to easily recognize the position of the ball mark by lighting and flickering, allow the golfer to more positively recognize the position of the ball mark and help the golfer to measure a distance. According to circumstances, the ball marker can adjust the degree of position indication so that other golfers can recognize the position of the ball marker passively. Moreover, the ball marker is easy to carry, and can be transformed into other type ball markers as occasion demands.

BRIEF DESCRIPTION OF THE DRAWINGS

FIG. 1 is a perspective view of a ball marker for golf according to a first preferred embodiment of the present invention.

FIG. 2 is an exploded perspective view of FIG. 1.

FIGS. 3 and 4 are sectional views showing a used state of the ball marker for golf according to the present invention.

FIG. 5 is an exploded perspective view showing a state where the ball marker for golf according to the present invention is attached to a clip coupler.

FIG. 6 is a perspective view of a ball marker for golf according to a second preferred embodiment of the present invention.

FIG. 7 is a sectional view of FIG. 6.

FIG. 8 is a sectional view showing modifications of a disc spring and a thin film printed circuit board.

FIG. 9 is a perspective view of a ball marker for golf according to a third preferred embodiment of the present invention.

FIG. 10 is an exploded perspective view of FIG. 9.

FIG. 11 is a sectional view of FIG. 9.

DESCRIPTION OF EMBODIMENTS

Reference will be now made in detail to the preferred embodiment of the present invention with reference to the attached drawings.

FIG. 1 is a perspective view of a ball marker for golf according to a first preferred embodiment of the present invention, FIG. 2 is an exploded perspective view of FIG. 1, FIGS. 3 and 4 are sectional views showing a used state of the ball marker for golf according to the present invention, and FIG. 5 is an exploded perspective view showing a state where the ball marker for golf according to the present invention is attached to a clip coupler.

First, referring to FIGS. 1 and 2, a ball marker (A) for golf according to a first preferred embodiment of the present invention has a diameter equal to or larger than a general coin size, and includes a round-shaped case 10 made of a synthetic resin material and having an opening 12. An uneven portion is formed on the bottom portion of the opening 12 of the round-shaped case 10, so that the disc spring 20 having a plurality of coupling pieces 22 formed on the outer circumference thereof can be fit into inner insertion grooves 14 of the round-shaped case 10.

The disc spring 20 is made of a nonconductive metal material or a flexible synthetic resin material, and curved upward convexly. The disc spring 20 is a plate spring, which becomes hollow downwardly when power is applied from the top and becomes convex upwardly when power is applied from the bottom, and includes a through hole 24 formed at the center thereof for an electric connection with an electric cell 42 located on a lower portion thereof.

A ring-shaped rim 41 for a reception of the electric cell 42 is spot-welded on the bottom surface of the center of the disc spring 20, and the electric cell 42 is received in a receiving portion formed inside the ring-shaped rim 41.

A manufacturer coincides the coupling pieces 22 of the disc spring 20 with an indent portion of the lower part of the round-shaped case 10, pushes the disc spring 20 into the inner insertion grooves 14 of the round-shaped case 10 and rotates the disc spring 20 a little to coincide coupling grooves between the coupling pieces 22 of the disc spring 20 with a plurality of insertion holes 52 formed on a rim portion of the round-shaped case 10, and then, forcedly fit magnet pieces 50 into the insertion holes 52. Then, the disc spring 20 is joined and fixed to the disc case 10.

After that, in a state where the disc spring 20 is turned upside down, the electric cell 42 is received into a lower insertion portion of the disc spring 20, and then, a button switch 44 and a button cover 46 are positioned on the electric cell in order. In this instance, it is preferable that the button cover 46 has a fitting portion formed integrally and fit to the outer surface of the ring-shaped rim 41 of the disc spring 20. The button cover 46 includes a lower projection 48 formed integrally on a lower portion thereof, and the lower projection 48 is formed in such a way as to project a little more from the bottom surface of the round-shaped case 10 in the original state where the disc spring 20 protrudes convexly (See FIG. 3). The lower projection 48 of the button cover formed as above can be easily retained to a retaining recess 64 of a clip coupler (B), which will be described later referring to FIG. 5.

Furthermore, as another embodiment of the button cover 46, the lower portion of the button cover 46 may be formed in a flat shape, from which the lower projection 48 is removed.

After the button cover 46 is mounted, liquid type soft resin is poured to the lower portion of the disc spring 20 and hardened to thereby form a lower fixing portion 54 on the disc spring 20.

After the soft lower fixing portion 54 is formed, the round-shaped case 10 is turned again in such a way that the upper portion of the round-shaped case 10 directs upward, and then, the thin film printed circuit board 30 having a bare chip type light-emitting diode flickering control chip 32 and a flexible printed circuit cable 34 connected to the thin film printed circuit board 30 and having a plurality of surface mounted device light emission diodes 36 are seated on the top surface of the disc spring 20 exposed to the upper portion of the round-shaped case 10. After that, a liquid type transparent rubber is poured and hardened on the thin film printed circuit board 30 and the flexible printed circuit cable 34 to thereby form a transparent rubber layer 40. The flexible printed circuit cable 34 may be formed in a spiral shape as shown in FIG. 2, or formed in such a way that multiple arrays of flexible printed circuit cables are radially arranged as shown in FIG. 10.

As an example, the thin film printed circuit board 30 is loosely fit to the through hole 24 of the disc spring 20 in such a way that a lower terminal piece 31 of the thin film printed circuit board 30 is electrically connected with the electric cell 42, and the flexible printed circuit cables 34 connected to the thin film printed circuit board 30 can be arranged on the top surface of the disc spring 20 evenly.

As another modification, as shown in FIG. 8, the disc spring 20 made of the nonconductive material has a communication hole formed at the center thereof and an electric connection portion 31*a* formed on the communication hole through a soldering treatment in such a way that the electric connection portion 31*a* of the communication hole electrically connects the terminal piece 31 formed on the bottom surface of the disc spring 20 and the flexible thin film printed circuit board 30 located on the top surface of the disc spring 20 with each other.

The light-emitting diode flickering control chip 32 mounted on the thin film printed circuit board 30 is electrically connected with the button switch 44 located below the light-emitting diode flickering control chip 32. Moreover, the light-emitting diode flickering control chip 32 programmably stores a light emission control and a lighting or flickering control cycle of the surface mounted device light emission diodes 36, which are mounted on the flexible printed circuit cable 34 connected to the thin film printed circuit board 30, in an inner memory, and controls light-emission of the surface mounted device light emission diodes 36 on the basis of the previously set program when the button switch 44 of the button cover 46 is pressed to be turned on.

The surface mounted device light emission diodes 36 formed on the flexible printed circuit cable 34 have various colors, such as bright red, blue, orange, white, and so on, and each of the surface mounted device light emission diodes 36 can emit light in high brightness for lighting or flickering.

In the present invention, when the program of the light-emitting diode flickering control chip 32 is mapped, it is embodied in such a way that the surface mounted device light emission diodes 36 of warning colors, such as the bright red or orange, which can be easily recognized even in strong sunlight or during hours of a great deal of sunshine, emit light, the surface mounted device light emission diodes 36 of bright colors, such as the white color, emit light at dawn or at night, and the surface mounted device light emission diodes 36 of colors similar to a golf course, such as the blue color or the green color, emit light in order not to be unpleasant to other golfers' eyes. In addition, the light-emitting diode flickering control chip 32 can control lighting states of the surface mounted device light emission diodes 36 to continuously keep the lighting state or flickering states of the surface mounted device light emission diodes 36 to light them intermittently.

In accordance with one embodiment, an active Radio Frequency Identification (RFID) tag (not shown) including a transponder chip and an antenna is installed in the round-shaped case 10, for instance, on the flexible printed circuit cable 34 having the surface mounted device light emission diodes 36 thereon or on the thin film printed circuit board 30, and the transponder chip is electronically associated or connected with the flickering control chip 32. In one embodiment, a RFID reader/writer records control instructions for turning on and off the surface mounted device light emission diodes 36 in the transponder chip of the RFID tag according to the user's request, and the flickering control chip 32 is configured to periodically read from the transponder chip and conduct turn-on or -off of the surface mounted device light emission diodes 36 accordingly.

The RFID configured to turn on and off the surface mounted device light emission diodes 36 may be embedded in the clip coupler (B) shown in FIG. 5, and a push button 68 for turning on and off the ball marker (A) may be provided in the clip coupler (B). A clip coupler including a RFID reader/writer can be configured to control up to dozens of ball markers at one time, while such a clip coupler may be configured to control approximately two to five ball markers collectively as one group.

There are various ways to activate flickering of the ball marker (A), and, in one embodiment, the ball marker (A) may be activated or deactivated by controlling the button switch 44 on or off. For instance, when three ball markers (A) form a group controlled by a clip coupler (B) including a RFID reader/writer, and the user prefers to use only one ball marker of the group, only one ball marker can be activated to flicker by turning on the push button 68 of the clip coupler (B) while turning on the button switch 44 of the only one ball marker to be used.

FIG. 6 is a perspective view of a ball marker (A) for golf according to a second preferred embodiment of the present invention, and FIG. 7 is a sectional view of FIG. 6.

The ball marker (A) for golf shown in FIGS. 6 and 7 according to the second preferred embodiment of the present invention is nearly similar to the ball marker (A) for golf shown in FIGS. 1 to 4, but further includes a solar cell part disposed on a portion of the top surface of the disc spring 20 and electrically connected to the thin film printed circuit board 30. The solar cell part 70 is laminatedly formed on the upper portion of the thin film printed circuit board 30 of the top surface of the disc spring 20 in such a way as not to be overlapped with the surface mounted device light emission diodes 36 arranged on the top surface of the disc spring 20.

The solar cell part 70 can be used as an auxiliary power source to operate the surface mounted device light emission diodes 36 to emit light by generating electric energy through a photoelectric conversion and transferring the electric energy to the thin film printed circuit board 30 after absorbing solar light. Furthermore, the solar cell part 70 can be used also as a main power source when the electric cell 42 completely discharges electricity.

Since the ball marker (A) for golf shown in FIGS. 1 to 4 or the ball marker (A) for golf shown in FIGS. 6 to 8 includes the disc spring 20, when the golfer selectively presses the upper portion or the lower portion of the ball marker (A), as shown in FIGS. 3 and 4, the upper portion of the ball marker (A) becomes upward convex or downward concave.

In case where the upper portion of the ball marker (A) becomes upward convex, the ball marker (A) emits light at a wide radiant angle in such a way that the golfers can positively recognize it as shown in FIG. 3. In case where the upper portion of the ball marker (A) becomes downward concave, the ball marker (A) emits light at a narrow radiant angle in a non-exposure state in such a way that other golfers recognize it a little less.

The golfer can press the button switch 44 of the button cover 46 with the hand, so that the ball marker (A) emits light. The ball marker (A) is realized in such a way as to emit different colors and keep the lighting state or the flickering state whenever the golfer presses it. According to one or more embodiments, remote controlling of the ball marker (A) based on RFID technology can provide golfers with more convenience in use. In one embodiment, the ball marker (A) is adapted to change colors of the diodes or to turn on and off the diodes by pressing the button switch 44. Moreover, the surface of the ball marker (A) can be shaped to be convex or concave.

Through the above control of the light emitting state, the golfer can conveniently adjust the degree of the position indication of the ball marker (A) as he or she wants. Particularly, the flickering control of the ball marker (A) for golf according to the present invention greatly helps the golfer to measure a distance between a hole cup and the position of the ball marker.

For instance, the golfer can easily measure the distance using the ball marker (A) emitting light of the warning color and making flicker. The golfer can put out the light of the ball marker (A), make the surface of the ball marker (A) in the concave state, or control the ball marker (A) to emit light similar to the golf course in order not to obstruct other golfer's play when other golfer putts a ball.

As described above, the ball marker (A) for golf according to the present invention can adjust the degree of the position indication of the ball marker (A) and is easy to carry.

The ball marker (A) for golf, whose upper portion is in the convex state, is easy to put in a pocket since the lower projection 48 projects a little below the bottom surface of the ball marker, and can be easily attached to a clip coupler (B) having the retaining recess 64 as shown in FIG. 5.

The clip coupler (B) shown in FIG. 5 is forcedly joined to the peak of the cap, and has a structure that a clip body 60 having a magnetic plate 62, on which the retaining recess 64 is formed, includes a fitting piece 66 formed integrally with the lower portion thereof.

When the ball marker (A) is put on the clip coupler (B) as shown in FIG. 5, the ball marker (A) is attached to the magnetic plate 62 of the clip coupler (B) via a magnetic force of magnet pieces 50 of the ball marker (A), and as shown in FIG. 3, a portion of the lower projection 48 of the button cover 46, which protrudes a little from the bottom surface of the ball marker (A), is retained to the retaining recess 64 of the clip coupler (B), whereby the ball marker (A) can keep a firmly attached state.

Moreover, the ball marker (A) for golf according to the present invention can be easily attached not only to the clip coupler (B) but also to other clip couplers.

FIGS. 9 to 11 illustrate a ball marker (A1) for golf according to a third preferred embodiment of the present invention, wherein FIG. 9 is a perspective view of a ball marker (A1) for golf according to the third preferred embodiment of the present invention, FIG. 10 is an exploded perspective view of FIG. 9, and FIG. 11 is a sectional view of FIG. 9.

The ball marker (A1) for golf according to the third preferred embodiment is similar to the ball markers (A) for golf shown in FIGS. 1 to 8, but does not include the disc spring 20.

The ball marker (A1) for golf according to the third preferred embodiment will be described in more detail. As shown in FIG. 10, a light-emitting diode flickering control chip 32 is mounted inside a round-shaped case 10*a* having an upper recess 82, and a thin film printed circuit board 30, to which flexible printed circuit cables 34 having a plurality of surface mounted device light emission diodes 36 are connected, is forcedly fit to the upper recess 82. After that, a plurality of solar cell parts 70 and one switch button 90 are laminatedly arranged on a portion of the top surface of the thin film printed circuit board 30 in such a way as not to be overlapped with the flexible printed circuit cables 34, and then, a transparent layer 92 is hardened and formed on the thin film printed circuit board 30 in such a way that the switch button 90 is exposed to the outside.

Furthermore, in the ball marker (A1) for golf, an electric cell 42 is inserted into a cell receiving recess 84 formed on the lower portion of the round-shaped case 10*a* in such a way as to be electrically connected with a terminal piece located beneath the lower portion of the thin film printed circuit board 30. In this instance, the electric cell 42 may be a consumable primary cell or a secondary cell capable of electric discharge and electric charging.

The switch button 90 may be constructed as a push type button or a touch type button, and the round-shaped case 10*a* may include a lower projection 94 formed on the bottom face thereof or does not include it.

In FIG. 10, the unexplained reference numeral 80 designates a coupling piece extended to the outer circumference of the thin film printed circuit board 30 and having insertion holes for inserting magnet pieces 50 thereinto, and 86 designates a terminal piece formed on the thin film printed circuit board 30.

In accordance with one embodiment, an active RFID tag (not shown) including a transponder chip and an antenna is installed in the round-shaped case 10*a* of the ball marker (A1) shown in FIGS. 9-11, for instance, on the thin film printed circuit board 30, and the transponder chip is electronically connected with the flickering control chip 32. In one embodiment, a RFID reader/writer records control instructions for turning on and off the surface mounted device light emission diodes 36 in the transponder chip of the RFID tag according to the user's request, and the flickering control chip 32 is configured to periodically read from the transponder chip and conduct turn-on or -off of the surface mounted device light emission diodes 36 accordingly.

Moreover, the clip coupler (B) shown in FIG. 9 has the same structure as the clip coupler (B) shown in FIG. 5.

The RFID configured to turn on and off the ball marker (A) may be embedded in the clip coupler (B) shown in FIG. 9, and a push button 68 for turning on and off the ball marker (A) may be provided in the clip coupler (B).

The ball marker (A1) for golf according to the third preferred embodiment shown in FIGS. 9 to 11 has a simple and firm structure, and is easy to charge and discharge electricity through a plurality of the solar cell parts 70.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

As described above, the ball marker for golf according to the present invention can be used as one of golf accessories.

The invention claimed is:

1. A ball marker for golf comprising:

a round-shaped case having an opening;

a disc spring fit to the round-shaped case;

a thin film printed circuit board and a flexible printed circuit cable seated on a top surface of the disc spring exposed to an upper portion of the round-shaped case, the thin film printed circuit board having a light-emitting diode flickering control chip, the flexible printed circuit cable being connected to the thin film printed circuit board and having a plurality of surface mounted device light emission diodes;

a transparent rubber layer hardened and formed on the thin film printed circuit board and the flexible printed circuit cable;

an electric cell received in a receiving portion of the disc spring exposed from a lower portion of the round-shaped case;

a button switch and a button cover laminatedly arranged on the electric cell; and a lower fixing portion comprising soft resin fused and fixed onto the disc spring.

2. The ball marker for golf according to claim 1, wherein magnet piece are forcedly fit into insertion holes of a rim portion of the round-shaped case.

3. The ball marker for golf according to claim 1, wherein the button cover comprises a lower projection.

4. The ball marker for golf according to claim 1, wherein the disc spring further comprises a solar cell part laminatedly formed on a portion of the top surface thereof and connected with the thin film printed circuit board.

5. A ball marker for golf comprising:

a round-shaped case having an upper recess;

a thin film printed circuit board fit into the round-shaped case and having a light-emitting diode flickering control chip, the thin film printed circuit board being connected with a flexible printed circuit cable having a plurality of surface mounted device light emission diodes;

a solar cell part and a switch button laminatedly arranged on a portion of an top surface of the thin film printed circuit board; and a transparent layer hardened and formed on the thin film printed circuit board in such a way that the switch button is exposed to the outside.

6. The ball marker for golf according to claim 5, further comprising an electric cell disposed beneath the thin film printed circuit board.

7. The ball marker for golf according to claim 5, wherein the round-shaped case further comprises a lower projection formed on a bottom surface thereof.

8. The ball marker for golf according to claim 1, wherein the round-shaped case further comprises a Radio Frequency Identification (RFID) tag including a transponder chip and antenna, the transponder chip electronically associated with the light-emitting diode flickering control chip so that an external RFID reader/writer records control instructions for turning on and off the surface mounted device light emission diodes in the transponder chip.

* * * * *